US005666814A

United States Patent [19]

Yamamoto

[11] Patent Number: 5,666,814

[45] Date of Patent: Sep. 16, 1997

[54] HEAT TRANSFER SYSTEM

[75] Inventor: Tadashi Yamamoto, Tsukuba, Japan

[73] Assignee: Agency of Industrial Science and Technology, Tokyo, Japan

[21] Appl. No.: 357,409

[22] Filed: Dec. 16, 1994

[30] Foreign Application Priority Data

Dec. 17, 1993 [JP] Japan ..... 5-343859

[51] Int. Cl.[6] ..... F28D 15/00

[52] U.S. Cl. ..... 62/118; 165/104.22; 62/119; 62/DIG. 2

[58] Field of Search ..... 62/118, 119, DIG. 2, 62/115; 417/52, 207; 165/104.13, 104.22, 104.14

[56] References Cited

U.S. PATENT DOCUMENTS

| | | | |
|---|---|---|---|
| 4,120,172 | 10/1978 | Pierce | 62/115 |
| 4,552,208 | 11/1985 | Sorensen | 165/104.22 |
| 4,625,790 | 12/1986 | Okayasu | 165/104.22 |
| 5,259,447 | 11/1993 | Ogushi et al. | 165/104.22 |

FOREIGN PATENT DOCUMENTS

| | | | |
|---|---|---|---|
| 1498943 | 8/1989 | U.S.S.R. | 417/52 |
| 1571287 | 6/1990 | U.S.S.R. | 417/207 |
| 1629596 | 2/1991 | U.S.S.R. | 417/207 |

*Primary Examiner*—William Doerrler

*Attorney, Agent, or Firm*—Oblon, Spivak, McClelland, Maier & Neustadt, P.C.

[57] ABSTRACT

The heat transfer system of the present invention transfers heat from above to below by means of phase change of an operating fluid without applying power from outside, and it facilitates to keep balance between evaporation quantity of the operating fluid by an evaporator and return quantity of the operating fluid from a condenser to the evaporator by a heat driving pump, and to improve heat transfer efficiency, heat transfer distance and heat transfer quantity. For this purpose, the condenser 2 is provided at a position lower than the evaporator 1, and the heat driving pump 3 is installed along a flow passage to send the operating fluid 9 from the condenser 2 to the evaporator 1. In the heat driving pump 3, air bubbles generated by heating of the high temperature fluid are condensed by cooling with the low temperature fluid, and by pressure change generated, the operating fluid 9 is sent back from the condenser 2 to the evaporator 9. Flow rate and temperature of the high temperature fluid for heating and the low temperature fluid for cooling are controlled by the heat driving pump 3 in order to control the return quantity of the operating fluid 9 sent from the condenser to the evaporator by the heat driving pump.

11 Claims, 1 Drawing Sheet

HEAT TRANSFER SYSTEM

BACKGROUND OF THE INVENTION

The present invention relates to a heat transfer system, which can efficiently transfer heat from a high temperature heat source at a higher position to a low temperature heat source at a lower position without applying power from outside, and in particular to a heat transfer system suitable for applications in exhaust heat recovery at various temperature levels discharged in an iron foundry and the like.

DESCRIPTION OF PRIOR ART

In the past, several proposals have been filed on heat transfer systems, which can transfer heat from a higher position to a lower position by utilizing the phase change of an operating fluid. In such a system, the operating fluid evaporated in an evaporator at a higher position is condensed by a condenser installed at a position lower than the evaporator, and the operating fluid condensed by the condenser is tranferred to the evaporator at a higher position, and heat is transferred from a high temperature heat source at a higher position to a low temperature heat source at a lower position. In these heat transfer systems, no mechanical power is applied from outside in case the operating fluid is circulated from the condenser to the evaporator and heat is transferred from the high temperature heat source to the low temperature heat source.

However, the conventional system as described above can transfer heat from the high temperature heat source to the low temperature heat source without applying mechanical power, while it is difficult to keep a balance between the evaporation quantity of the operating fluid evaporated by the evaporator and the pumped quantity of the operating fluid pumped up by the condenser. Efficient heat transfer cannot be carried out if an imbalance occurs between these quantities. Also, heat transfer by the above system is limited to the application for heat transfer of a relatively short distance and the heat quantity to be transferred is also low, and it is difficult to transfer a large quantity of heat for a distance of several meters in industrial scale.

SUMMARY OF THE INVENTION

It is an object of the present invention to provide a heat transfer system, by which it is possible to improve the balance between evaporation quantity of the operating fluid evaporated by an evaporator and the quantity of fluid pumped up by a heat driving pump to increase heat transfer efficiency, and to increase the transfer distance and the heat transfer quantity when heat is transferred from a high temperature heat source at a higher position to a low temperature heat source at a lower position.

To attain the above object, the heat transfer system of the present invention basically comprises an evaporator for heating an operating fluid by a high temperature heat source, a condenser installed at a position lower than the evaporator and used for condensing the operating fluid evaporated in the evaporator, a heat driving pump for transferring the operating fluid from the condenser to the evaporator due to a pressure change generated in a pressure generating pipe, the pressure generating pipe being installed along a flow passage for circulating the operating fluid to the evaporator and being alternately provided with a plurality of heating zones where the operating fluid is heated by a high temperature fluid and with a plurality of cooling zones where the operating fluid is cooled by a low temperature fluid, the pressure change being generated by the generation of air bubbles due to heating of the operating fluid in the pressure generating pipe and by extinction of air bubbles caused by cooling, and control means for controlling the generation and condensation of the air bubbles by controlling the high temperature fluid and the low temperature fluid supplied to the heat driving pump.

The heat driving pump is designed in such manner that, in a passage for circulating the operating fluid from the condenser to the evaporator, a pressure generating pipe is installed, which is alternately provided with a heating zone where the operating fluid is heated by a high temperature fluid and cooling zones where the operating fluid is cooled by a low temperature fluid, and the operating fluid is transferred from the condenser to the evaporator because of the pressure change caused in the pipe by the generation of air bubbles due to heating of the operating fluid in the pressure generating pipe and the elimination of the air bubbles caused by cooling.

In the heat transfer system as described above, an overflow pipe for returning an excessive quantity of the operating fluid, circulated to the evaporator, to the condenser may be installed between the evaporator and the condenser, and the heat driving pump may be installed at a position higher than the evaporator.

In the heat transfer system with the above arrangement, the operating fluid heated and evaporated by the high temperature heat source in the evaporator flows into the a condenser, stored in the condenser as condensed fluid, and heat of the condensed fluid pooled in the condenser can be used for various purposes.

On the other hand, in the heat driving pump, air bubbles are repeatedly generated and extinguished in a longitudinal direction of the pressure generating pipe in response to heating of the operating fluid in the pressure generating pipe by the high temperature fluid and to cooling of the heated operating fluid by the low temperature fluid, and a pressure change occurs. By suction of the operating fluid from the condenser and by forced feeding of the fluid to the evaporator due to the pressure change, the operating fluid is transferred. In this heat driving pump, by adjusting generation and condensation of the air bubbles by the control means, supply of the operating fluid in the heat driving pump can be controlled, and an imbalance between supply quantity and evaporation quantity of the operating fluid with respect to the evaporator can be improved.

Even when an excessive quantity of the operating fluid is circulated to the evaporator by the heat driving pump and an imbalance occurs, the imbalance can be readily resolved because the excessive quantity of the operating fluid is bypassed through the overflow pipe to the condenser, and the overflow pipe also facilitates transfer quantity control of the heat driving pump.

DETAILED DESCRIPTION OF THE PREFERRED EMBODIMENT

Figure 1:
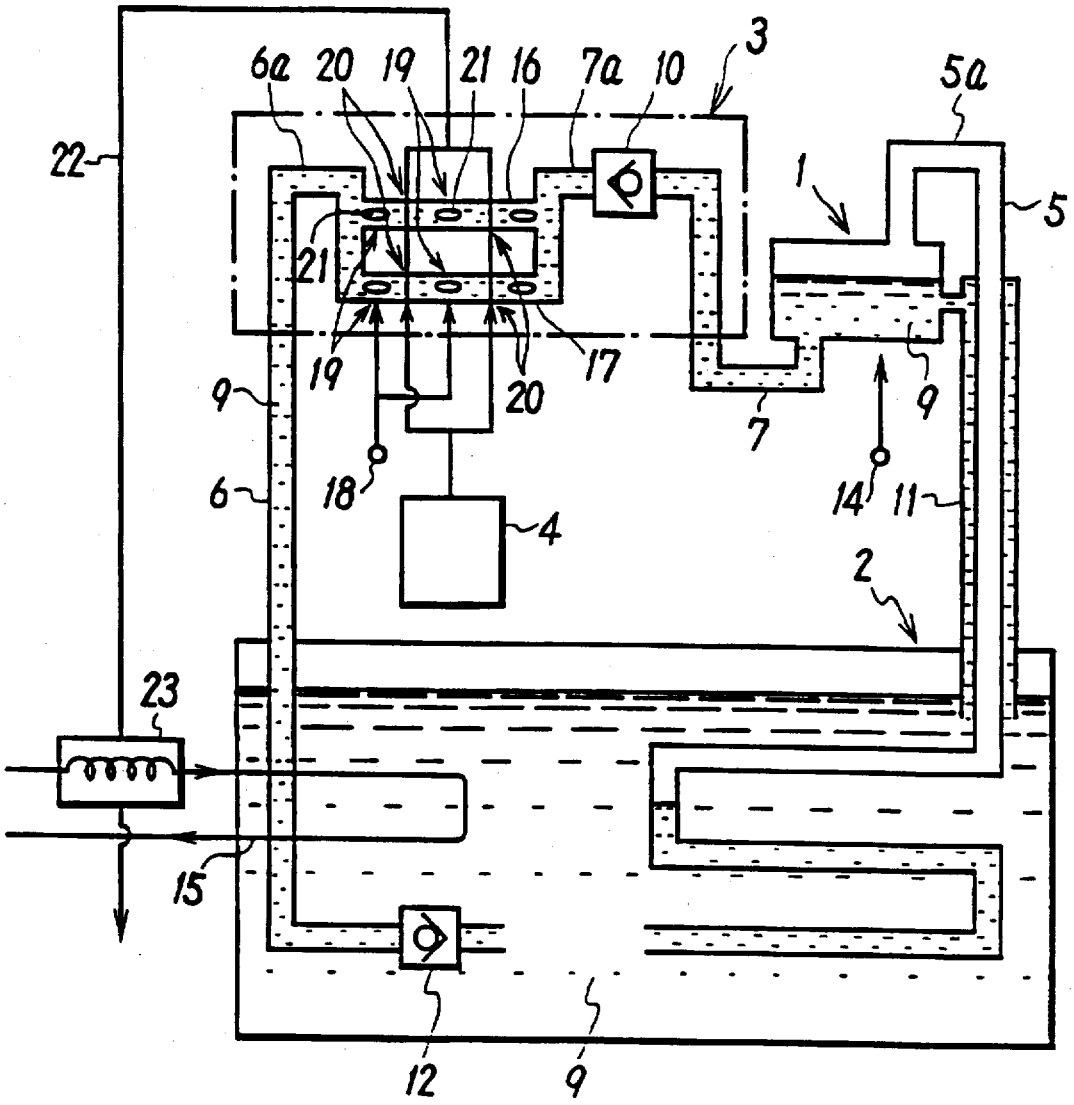
FIG. 1 schematically illustrates principle of an embodiment of a heat transfer system according to the present invention.

FIG. 1 is a schematical drawing showing the principle of an embodiment of a heat transfer system of the present invention.

The heat transfer system comprises an evaporator 1 for heating an operating fluid by a high temperature heat source 14, a condenser 2 installed at a position lower than the evaporator 1 and used for condensing the operating fluid evaporated in the evaporator 1, a heat driving pump 3 for transferring the operating fluid from the condenser 2 to the evaporator 1, and control means 4 for controlling condensation of air bubbles through control of quantity of a low temperature fluid supplied to the heat driving pump 3. The evaporator 1 and the condenser 2 are connected with each other by a transport pipe 5, and the condenser 2 and the heat driving pump 3 are connected with each other by a return flow pipe 6. The evaporator 1 and the heat driving pump 3 are connected with each other by a connecting pipe 7.

The vapor transport pipe 5 connected to the evaporator 1 is connected above the vapor layer of the evaporator 1 and extends upward. Then, it extends downward via a bent portion 5*a* and opens into a condenser 2. In the condenser 2, an operating fluid 9 to be used in circulation is filled in a condensed state, and the vapor transport pipe 5 is bent in an S-shape under the liquid surface in the condenser 2. The evaporator 1 is provided with an overflow pipe 11, which is connected to the upper portion of fluid layer of the evaporator, extends downward and opens into the condenser 2, and the vapor transport pipe 5 is passed through the overflow pipe 11. The position of the opening of the upper end of the overflow pipe 11 to the evaporator is determined in relation to the height of the maximum allowable fluid surface in the evaporator 1.

On the other hand, under the liquid surface of the operating fluid 9 in the condenser 2, a return flow pipe 6 with a non-return valve 12 for preventing counterflow attached on the forward end of it is installed, and the return flow pipe 6 is extended upward and is turned downward via a bent portion 6*a*, and its tip is connected to the suction side of the heat driving pump 3. A connecting pipe 7 connected to the discharge side of the heat driving pump 3 extends upward and then turns downward via an upper bent portion 7*a* and is connected to lower portion of the fluid layer of the evaporator 1. Further, on the upper bent portion of the connecting pipe 7, a non-return valve 10 is attached in order to prevent counterflow of the operating fluid 9 to be sent to the evaporator.

The evaporator 1 heats and evaporates the operating fluid 9, returned from the heat driving pump 3 via the connecting pipe 7, by a high temperature heat source 14, and allows the evaporated operating fluid 9 to flow into the condenser 2 through the vapor transport pipe 5. The condenser 2 serves as a low temperature heat source, condenses the vapor sent from the evaporator 1 and retains heat in the operating fluid 9. Through heat exchange with the fluid in a heat outflow pipe 15 for heat utilization, the heat is used for various applications. In the case where water is used for cooling, it is injected to the outlet of a heat exchanger 23 attached to the heat outflow pipe 15.

The heat driving pump 3 is installed at a position higher than the evaporator 1 and is provided with upper and lower pressure generating pipes 16 and 17 arranged in parallel to each other. Suction side of each of the pressure generating pipes 16 and 17 is connected respectively to the return flow pipe 6 for circulating the operating fluid 9, and the connecting pipe 7 is connected to the discharge side of each of the pressure generating pipes. The pressure generating pipe is divided into upper and lower pressure generating pipes 16 and 17 because it is possible to allow the operating fluid to escape, to increase the effect to cause a pressure change at the junction of the two pressure generating pipes and to empirically widen the operating range of the heat driving pump.

In the pressure generating pipes 16 and 17 in the heat driving pump 3, there are a plurality of heating zones 19 where the operating fluid 9 inside is heated by a high temperature fluid coming from the high temperature heat source 18 and a plurality of cooling zones 20 for cooling the heated operating fluid 9 by a low temperature fluid sent via low temperature fluid control means 4 for controlling supply of the low temperature fluid (such as water, air, etc.). These zones are alternately arranged in the longitudinal direction of the pipe. Supply routes of the high temperature and low temperature fluids for providing the heating zones 19 and the cooling zones 20 are formed by branched routes as shown in the figure.

The control means 4 installed on the supply route of the low temperature fluid controls condensation of air bubbles 21 generated in the pressure generating pipes 16 and 17 due to heating by the high temperature fluid by controlling supply conditions such as supply quantity or temperature of the low temperature fluid.

In the heat driving pump 3, another control means may be provided, which controls the generation and condensation of the air bubbles of the operating fluid 9 by controlling the high temperature fluid to be supplied or both the high temperature and low temperature fluids.

When the operating fluid 9 in the heating zones 19 of the pressure generating pipes 16 and 17 is heated by the high temperature fluid, the air bubbles 21 are generated in the heated portion of the operating fluid, and the air bubbles are cooled by the low temperature fluid in the cooling zones 20 of the pressure generating pipes 16 and 17 and are condensed and extinguished. Through generation and extinction of these air bubbles, which occur alternately in longitudinal direction in the pipes, small pressure changes occur within the pressure generating pipes 16 and 17. As a result, the heat driving pump 3 can send the operating fluid 9 from the condenser 2 to the evaporator 1. In other words, by the generation of the air bubbles 21 in the pressure generating pipes 16 and 17, the operating fluid 9 is forcibly fed to the evaporator 1. By pressure decrease when the air bubbles 21 are cooled and condensed, the operating fluid 9 is sucked from the condenser 2 through the return flow pipe 6. By continuously repeating this procedure, the operating fluid 9 is sent to the evaporator 1.

In order to recover heat, which is retained by the low temperature fluid used for the cooling of the pressure generating pipes 16 and 17 of the heat driving pump 3, a recovery pipe 22 of the low temperature fluid is connected to a heat exchanger 23, which is installed between the recovery pipe 22 and the heat outflow pipe 15. In the case where water is used for cooling, it is injected into the heat outflow system 15 through outlet of the heat exchanger 23.

Next, a description will be given on the operation of the above heat transfer system.

The operating fluid 9 heated and evaporated by the high temperature heat source 14 in the evaporator 1 is sent to the condenser 2 via the vapor transport pipe 5 and is stored in the condenser 2 as condensate. The heat retained by the operating fluid 9 in the condenser 2 is taken up and used for various applications through the heat outflow pipe 15. On the other hand, in the heat driving pump, generation and extinction of the air bubbles 21 occur alternately in longitudinal direction inside the pressure generating pipes 16 and 17 due to heating of the operating fluid 9 in the pressure generating pipes 16 and 17 by high temperature fluid for pump driving and by cooling of the operating fluid by the low temperature fluid. As a result, a pressure change occurs.

By this pressure change, the operating fluid 9 is sent from the condenser 2 to the evaporator 1 through the return flow pipe 6.

In the heat driving pump 3, if heat by the high temperature fluid is excessively supplied, condensation of the air bubbles 21 generated in the pressure generating pipes 16 and 17 becomes incomplete, and the performance ability of the heat driving pump is decreased. By adjusting condensation of the air bubbles 21 through control of the low temperature fluid by means of the control means 4, the supply of the operating fluid 9 in the heat driving pump 3 can be controlled. Further, by controlling both the high temperature and low temperature fluids, it is possible to more precisely adjust the supply quantity of the operating fluid.

By adjusting transfer quantity of the operating fluid transferred by the heat driving pump 3, the return quantity of the operating fluid 9 to be returned to the evaporator 1 can be adjusted according to the evaporation quantity of the fluid evaporated in the evaporator 1, and an imbalance between the supply quantity and the evaporation quantity of the operating fluid with respect to the evaporator 1 can be improved.

Even when an excessive quantity of the operating fluid 9 is sent back to the evaporator 1 by operation of the heat driving pump 3 and an imbalance occurs, the operating fluid 9 is sent back to the condenser 2 through the overflow pipe 11, and the imbalance can be readily overcome, and the overflow pipe 11 facilitates control of transfer quantity of the fluid by the heat driving pump 3. Condensation of the vapor in the vapor transport pipe 5 can also be promoted by the operating fluid 9, which is sent back to the condenser 2 through the overflow pipe 11.

As it is evident from the above description, it is possible according to the above heat transfer system to improve imbalance between the evaporation quantity of the operating fluid by the evaporator and the quantity of the fluid pumped up by the heat driving pump, to increase heat transfer efficiency, to increase transferred heat quantity and transfer distance, and to transfer as much heat as desired from the high .temperature heat source, where an ordinary heat pipe is not applicable, to a low temperature heat source located at a relatively distant position.

What we claim are:

1. A heat transfer system, comprising:

an evaporator for heating an operating fluid by a high temperature heat source;

a condenser installed at a position lower than the evaporator and used for condensing the operating fluid evaporated in the evaporator;

a heat driving pump for transferring the operating fluid from the condenser to the evaporator due to a pressure change generated in a pressure generating pipe, said pressure generating pipe being installed along a flow passage for circulating the operating fluid to the evaporator and being alternately provided with a plurality of heating zones where the operating fluid is heated by a high temperature fluid and with a plurality of cooling zones where the operating fluid is cooled by a low temperature fluid, said pressure change being generated by generation of bubbles due to heating of the operating fluid in the pressure generating pipe and by extinction of bubbles caused by cooling; and control means for controlling generation and condensation of the bubbles by controlling said high temperature fluid and said low temperature fluid supplied to the heat driving pump.

2. A heat transfer system according to claim 1, wherein the pressure generating pipe comprises an upper pressure generating pipe and a lower pressure generating pipe.

3. A heat transfer system according to claims 1 or 2, wherein the control means for controlling generation and condensation of the air bubbles controls at least one of a supply quantity and a temperature of at least one of the high temperature fluid and the low temperature fluid supplied to the heat driving pump.

4. A heat transfer system according to claim 1, further including an overflow pipe for returning an excessive quantity of operating fluid sent to the evaporator, said overflow pipe extending between the evaporator and the condenser.

5. A heat transfer system according to claim 4, further including a vapor transport pipe for connecting the evaporator and the condenser, said vapor transport pipe passing through the overflow pipe.

6. A heat transfer system according to claim 1, further including a heat outflow pipe for sending heat of the operating fluid in the condenser to outside, and wherein the heat outflow pipe is provided in the condenser.

7. A heat transfer system according to claim 6, further including a recovery pipe of low temperature fluid for recovering retained heat of the low temperature fluid used for cooling of the pressure generating pipe of the heat driving pump, and wherein said recovery pipe is connected to a heat exchanger installed between the recovery pipe and the heat outflow pipe.

8. A heat transfer system according to claim 5, wherein the vapor transport pipe is bent in an S-shape under a liquid surface in the condenser.

9. A heat transfer system according to claim 1, further including a non-return valve attached on a connecting pipe which connects the evaporator with the heat driving pump.

10. A heat transfer system according to claim 1, further including a non-return valve attached on a tip of a return flow pipe connecting the condenser with the heat driving pump, and wherein said tip is disposed under a liquid surface in the condenser.

11. A heat transfer system according to claim 1, wherein the heat driving pump is installed at a position higher than the evaporator.

* * * * *